United States Patent [19]

Osswald et al.

[11] Patent Number: 4,505,052

[45] Date of Patent: Mar. 19, 1985

[54] AIR BLAST APPARATUS FOR THE DRYER SECTION OF A PAPER MAKING MACHINE

[75] Inventors: Manfred Osswald; Hanns Rau; Hans-Joachim Fissmann, all of Heidenheim, Fed. Rep. of Germany

[73] Assignee: J. M. Voith, GmbH, Heidenheim, Fed. Rep. of Germany

[21] Appl. No.: 495,834

[22] Filed: May 18, 1983

[30] Foreign Application Priority Data

May 28, 1982 [DE] Fed. Rep. of Germany ..... 3220076

[51] Int. Cl.[3] ..... F26B 11/02

[52] U.S. Cl. ..... 34/114; 34/111; 34/116

[58] Field of Search ..... 34/111, 114, 116, 123, 34/155

[56] References Cited

U.S. PATENT DOCUMENTS

| | | | |
|---|---|---|---|
| 3,110,575 | 11/1963 | Justus | 34/116 |
| 3,263,344 | 8/1966 | Stickle | 34/116 |
| 3,320,677 | 5/1967 | Reitzel | 34/111 |
| 3,325,909 | 6/1967 | Clark | 34/111 |
| 3,337,968 | 8/1967 | Krikorian et al. | 34/111 |
| 3,388,479 | 6/1968 | Gardner | 34/116 |
| 3,427,727 | 2/1969 | Villalobos | 34/155 |
| 3,668,787 | 6/1972 | Berg et al. | 34/116 |

*Primary Examiner*—Edward G. Favors
*Assistant Examiner*—Steven E. Warner
*Attorney, Agent, or Firm*—Lon H. Romanski

[57] ABSTRACT

In the dryer section of a paper making machine, the paper web is pressed against the drying cylinders by means of an air-permeable endless support band. An air blast apparatus extends transversely of the paper making machine and creates an air flow which is directed generally across and through the support band and onto the paper web. The air blast apparatus has at least one blow orifice in the form of a ring slot with two longitudinal slots extending generally longitudinally of the air blast box or housing of the air blast apparatus, and at least generally transversely of the paper web and the support band. The blowing directions of the two longitudinal slots may be at different angles with respect to the running direction of the support band.

11 Claims, 4 Drawing Figures

Fig.1
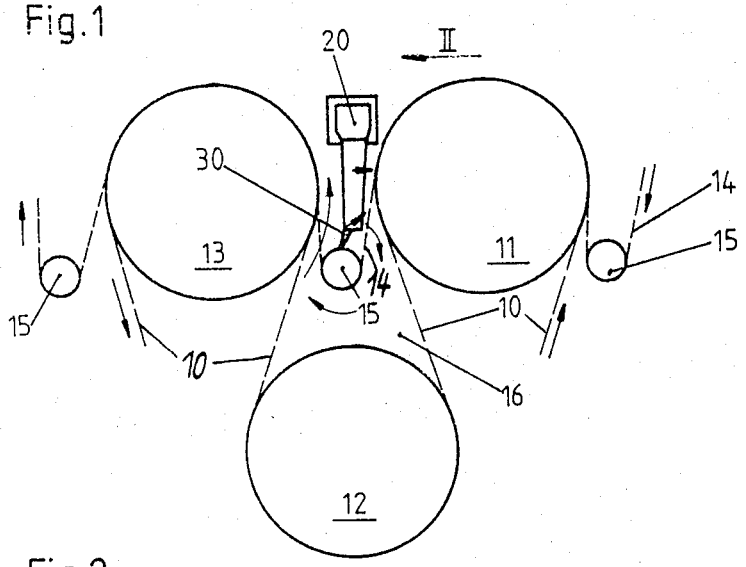
Fig.2
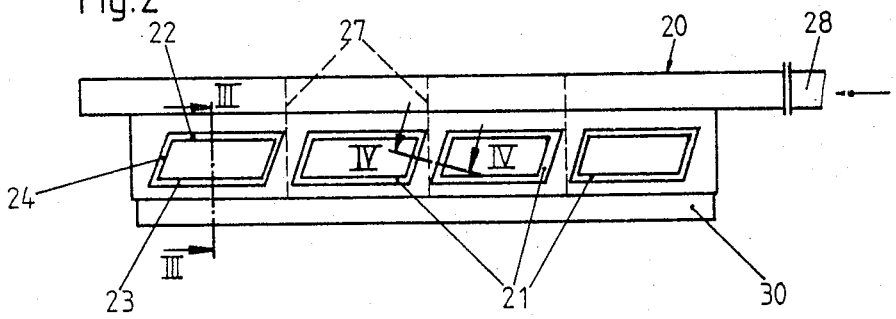
Fig.3
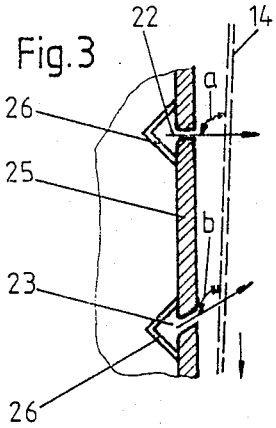
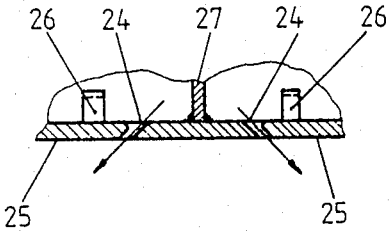
Fig. 4

AIR BLAST APPARATUS FOR THE DRYER SECTION OF A PAPER MAKING MACHINE

FIELD OF THE INVENTION

This invention relates generally to paper making machines and more particularly to the dryer section of such a paper making machine and, still more particularly, to apparatus for use with such a dryer section for enhancing the removel of moisture and thereby enhance the drying of the paper being dried in said dryer section.

BACKGROUND OF THE INVENTION

It is known that in the dry or drying end section or portion of a paper making machine the moisture-bearing paper web is directed along a serpentine path in wrapping relation with drying cylinders or drums arranged in tiers and having the cylinders in one tier staggered with respect to the cylinders or drums in the other tier. The dryer drums are heated, as by steam, and the traveling paper web is urged against the heated drums as by a porous, air-permeable endless support band which may be a felt generally woven from cotton or a plastic wire fabric belt. Generally, each tier of drying cylinders has such a support band or felt associated therewith. That is, the upper support band or felt presses the paper web against the drying cylinders of the upper tier while the lower support band or felt presses the paper web against the drying cylinders of the lower tier. As is known in the art, the respective support bands run between pairs of drying cylinders over a deflecting means such as, for example, a guide roller. In its travel as from an upper to a lower situated drying cylinder, or vice-versa, the paper web runs freely, that is, without in any way being supported by one of the support bands. As a consequence of such an arrangement a pocket is created and defined as between the lengths of run-on and run-off of paper web (as between succeeding drying cylinders), the uncovered portion of a drying cylinder and the juxtaposed portion of the support band, of the other tier of drying cylinders, juxtaposed to said uncovered portion of said drying cylinder. As is known and as should be apparent, usually there are a plurality of such pockets in the drying end section of the paper making machine. The moisture evaporating from such run-on and run-off portions of the paper web collects within such pockets and creates a condition of high humidity therein and interferes with the maintenance of a desired drying temperature.

In the prior art, such moisture or vapor within the pockets is attempted to be removed therefrom as by causing the vapor to flow through the porous support belt or felt, or, generally laterally across and beyond the porous support felt and free running paper web.

U.S. Pat. No. 3,110,575 teaches the use of blast air blown through the support band or felt on one side of the related guide roll while, on the other side of such guide roll, a suction box is provided serving to receive vapors or moist air again passing out of the pocket and through the support band. In such an arrangement, of course, there is an attendant relatively high cost of construction and additional operating energy must be provided for the operation of the pumping means, for supplying the air blast, and for the operation of the suction boxes.

U.S. Pat. No. 3,427,727 discloses the use of an air blast box to provide air stream against and through the support band or felt. The air stream created is, in turn, peripherally contained or confined by a rectangular "air curtain" produced by a rectangular generally continuous slot or blow orifice. According to the patentee in said U.S. Pat. No. 3,427,727, the "air curtain" serves the purpose of permitting the blast of air to pass through the support band or felt with as little as possible attendant swirling of such air. However, a plurality of blow or air blast orifices 74—74 are provided in each of face of discharge plates 52 and 54 and such orifices 74 or more specifically, pairs of such orifices 74, within the blow zone between the box 28 and the support band, will create a plurality of respective swirl zones resulting in a loss of flow through the support band or felt. As a consequence high energy usage and losses are experienced in the creation of the air stream in the arrangement of said U.S. Pat. No. 3,427,727. Further, the box or apparatus 28 (of U.S. Pat. No. 3,427,727) supplies such air to both sides of the related guide roll 20. Consequently, the moisture laden air within the pocket can move out of such pocket only by moving laterally, with respect to such support band and paper web. This type of flow, in turn, causes the edges of the paper web to flutter (much as the free end of a flag in a strong wind) thereby increasing the danger of having the paper web tear.

The invention as herein disclosed and described is primarily directed to the solution of the foregoing as well as other related and attendant problems of the prior art.

SUMMARY OF THE INVENTION

According to the invention, an air blast apparatus for a dryer section of a paper making machine having a plurality of drying cylinders comprising an upper tier and a lower tier for having a paper web trained therethrough, an endless gas-permeable support band urged against the paper web while the paper web is trained over the drying cylinders in the upper and lower tiers, a pocket formed generally by run-off and run-on portions of said paper web as said paper web passes from a first drying cylinder of one of said tiers to a drying cylinder of the other of said tiers and from said drying cylinder of said other of said tiers to a second drying cylinder of said one of said tiers, guide roller means situated generally between said first and second drying cylinders, said pocket being also formed by said endless support band as it passes from said first drying cylinder about said guide roller means and to said second drying cylinder, said air blast apparatus comprising air blast housing means situated as to extend transversely to the running direction of said endless support band, blow orifice means carried by said air blast housing means, said blow orifice means comprising a continuous ring slot orifice, said continuous ring slot orifice circumscribing a generally centrally situated land portion, said continuous ring slot orifice comprising first and second longitudinal slots extending generally transversely of the running direction of said endless support band, said first longitudinal slot being the first of said longitudinal slots traversed by said support band in the running direction of said support band, said second longitudinal slot being the second of said longitudinal slots traversed by said support band in the running direction of said support band, the blow direction of said first longitudinal slot being generally normal to the running direction of the support band running therepast, and the blow direction of said second longitudinal slot being at an obtuse angle with respect to the running direction of the support band running therepast.

Various general and specific objects, advantages and aspects of the invention will become apparent when reference is made to the following detailed description considered in conjunction with the drawings.

BRIEF DESCRIPTION OF THE DRAWINGS

In the drawings wherein for purposes of clarity certain details and/or elements may be omitted from one or more views:

FIG. 1 is a schematic view of a portion of the dryer section of a paper making machine illustrating an air blast apparatus employing teachings of the invention;

FIG. 2 is a view of the air blast apparatus of FIG. 1 taken generally in the direction of arrow II of FIG. 1;

FIG. 3 is a fragmentary cross-sectional view, in relatively enlarged scale, taken generally on the plane of line III—III of FIG. 2 and looking in the direction of the arrows; and FIG. 4 is a fragmentary cross-sectional view, in relatively enlarged scale, taken generally on the plane of line IV—IV of FIG. 2 and looking in the direction of the arrows.

DETAILED DESCRIPTION OF THE PREFERRED EMBODIMENT

Referring now in greater detail to the drawings, FIG. 1 illustrates the usual arrangement of two tiers of drying cylinders or drums with the upper tier being comprised of drying cylinders 11 and 13 and the lower tier being comprised of drying cylinders of which the one at 12 is typical. The paper web 10 to be dried runs or passes alternately over an upper tier cylinder, such as at 11, and lower tier drying cylinder, such as at 12, and then again over an upper tier cylinder, such as at 13. While the paper web 10 passes over the upper tier drying cylinders 11 and 13, such paper web is pressed against the upper drying cylinders 11 and 13 by an upper situated endless air-permeable support belt or band 14 running in synchronous speed with the paper web 10. The lower situated endless air-permeable support band, functionally equivalent to support band 14, associated with drying cylinder or rollers means 12 has been omitted from the drawings. Between pairs of drying cylinders, as depicted by cylinders 11 and 13, the support band 14 passes over and generally about guide roller means 15. As a consequence, and as generally previously discussed, a so-called pocket 16 is formed and defined as by the lower drying cylinder 12, the paper web 10 run-off from drying cylinder 11 onto the lower drying cylinder 12, the paper web run-off from drying cylinder 12 onto drying cylinder 13 and the support band 14 portion generally spanning the distance between adjacent drying cylinders 11 and 13. As should be apparent, especially in view of the prior art herein specifically referred-to, a plurality of such pockets are usually formed and, with respect to FIG. 1, similar pockets could be formed to either side of lower drying cylinder 12 with, in such cases, drying cylinders 11 and 13 forming respective one ends of such pockets.

An air blast box or apparatus 20, embodying teachings of the invention, is disposed generally between drying cylinders 11 and 13 and is situated relatively closer to drying cylinder 11 from which the support band or felt 14 runs-off toward guide roller means 15. It is precisely in this run-off zone of the support band 14 that the air blast box means 20 has blow orifices so that hot air, provided by the air blast box means and associated blow orifices, passes through the support band 14, in such run-off zone, and into the pocket 16. There is a natural tendency for the vapors within the pocket 16 to experience a generally clockwise flow, about guide roller means 15 as generally depicted by the arrows in FIG. 1. Such vapor flow, caused by the pumping action resulting from the running of the support band 14, results in a vapor flow out of the pocket 16 through support band 14 generally in the area between guide roller means 15 and drying cylinder 13; such may be considered as being generally at the back side of the air blast box 20. Such pumping action and air or vapor flow leaving pocket 16, brought about by the pumping effect of running support band 14, is intensified and enhanced by the air blast box means 20.

Referring to FIG. 2, it can be seen that the air blast box means 20 comprises a plurality of slot type air blast orifices 21 which, effectively, surround respective field or plate portions 25. In the preferred arrangement, the field or plate portions 25 are each of a parallelogram outer configuration and the orifices 21 are endless "ring slots" with each ring slot 21 comprising two longitudinal slot portions 22 and 23 and two transverse slot portions 24—24. It is to be understood that the term or expressions, ring slots, or ring slot, is intended to encompass all possible forms or configurations of endless slot blow orifices, respectively surrounding a certain area or body portion, and not merely a configuration of a circular ring.

Referring to FIG. 3, it can be seen that the blow direction, of what in the running direction of the support band 14 is the first longitudinal slot 22 forms a substantially right angle "a" with the running direction of the support band 14. However, it has been determined that acceptable results are achieved when the magnitude of the direction angle "a" is in the order of 70° to 110°. In the preferred embodiment, the air blowing direction, of what in relation to the running direction of the band 14, is the second longitudinal slot 23, is inclined with respect to the running direction of the support band 14. That is, the direction of air blow through and from slot portion 23, preferably, forms an obtuse angle "b", of a magnitude in the order of 100° to 140°, with the running direction of support belt or band 14. As possibly best illustrated in FIG. 4, the transverse slot portions or section 24 of a single ring slot 21 may be so formed or inclined as to cause the direction of the air blow therefrom to be directed generally toward each other. However, in another embodiment of the invention not shown in the drawing, the blow direction of such transverse slot segments may form a substantially right angle with the plane of the wall members 25.

From FIGS. 3 and 4 it can be seen that in the preferred embodiment the medially situated wall or land portion 25, defining the inner boundary of the continuous slot 21, is operatively secured to the adjacent wall or support structure as by a plurality of bridging bracket means 26.

Preferably, the interior of the air blast box means 20 is divided into several chambers or compartments as by means of transverse walls 27 in such a manner as to have a ring slot 21 for each such chamber or compartment. Even though only a single air feed channel means 28 is illustrated as supplying all of such plurality of chambers (leading to respective ring slots 21) it should be understood that separate air feed passages may be employed with respective ones thereof communicating with respective ones of such chambers or compartments (leading or feeding respective ring slots 21).

With the invention, the use of circular blow orifices as at 74—74 of U.S. Pat. No. 3,247,727 for the creation of the air stream is no longer necessary. It has, in fact, been discovered that with ring slots of the invention it is possible to create one or more annular-like air curtains and thereby create a very effective air stream through the support band with even a very low expenditure of energy. This is believed due to the fact that the two longitudinal slots 22, 23 form very concentrated, laminar air jets which pass through the support band without any appreciable disturbance to flow. Further, the air being blown through the continuous ring slot 21 of the invention forms a continuous and peripherally endless air curtain the interior of which experiences an air pressure cushion which continually exists as between the air blast box 20 and the juxtaposed portion of the support band means 14 thereby assuring a high volume of air flow, in such region, through the support band means 14.

The ring slots 21 of the invention may have varying forms or configurations, especially when and if several ring slots 21 are arranged in a row, or in two rows lying side-by-side. Very successful results have been obtained when the ring slots 21 of the invention have been made in the form of slender parallelograms or trapeziums. By doing so the paper web 10, as in the run-off and run-on portions, is pressurized as uniformly as possible by the air stream so that local overheating or moist stripes in such paper web are avoided. Further, it has been discovered that the ring slots 21 of the invention may also be triangular and/or arcuate segments. In an arrangement of two adjacent rows, ring slots 21 of pentagonal configuration are possible. Where transverse slot portions are provided, it is advantageous to incline their air blowing direction toward a generally medial or central location with respect to the ring slot.

Further, the air blast box 20 of the invention can be arranged or situated at a relatively great distance from the nearest drying cylinder, as cylinder 11. As a consequence of that, there is no danger, when waste occurs, as is never quite avoidable (as in the case of so-called packing or jamming of the drying cylinder 11), that the support band or felt 14 might come into contact with the air blast box means 20. Further, in such an arrangement, sufficient space exists between the drying cylinder 11 and the air blast box 20 to pass through a pull-in rod when inserting a new support band 14.

In order to positively assure that virtually the entire flow of air issuing from air blast box 20 passes through the support band 14 into pocket 16, a suitable sealing strip 30 is provided as between air blast box 20 and guide roll means 15. Such sealing means 30 may operatively engage or come into close but spaced relationship with guide roll means 15.

Also, it should be pointed-out that the above-described air flow, which passes into and through pocket 16 and from pocket 16 upwardly through the support band 14 at the back of air blast box 20, is totally sufficient for increasing the capacity of the overall drying end section and for the removal of moist air. Therefore, the provision of suction means as disclosed in U.S. Pat. No. 3,110,575 may be omitted.

In said U.S. Pat. No. 3,110,575 the patentee attempts to control the so-called moisture profile of the paper web by varying the air streams in adjacent air blast zones. That is, it is desirable that the finished paper web has a residual moisture content, over its entire width, which is as uniform as possible. Structures employing the teachings of said U.S. Pat. No. 3,110,575 have not been successful in achieving the desired uniformity. However, it has been discovered that air blast boxes according to the invention provide surprisingly uniformity in residual moisture content in the paper web. Even though the reasons are not, for certain, known, it is believed that such uniformity of residual moisture is achieved because the air blast issuing from a selected ring slot 21 does not spread in transverse or lateral directions (relative to the paper making machine), or does so only very slightly, before it impinges on the paper web.

As should be apparent, air blast boxes 20 may also be provided as between successive drying cylinders of the lower tier, of which cylinder 12 may be one, in the manner as disclosed with reference to the upper tier.

Although only a preferred embodiment and selected modifications of the invention have been disclosed and described, it is apparent that other embodiments and modifications of the invention are possible within the scope of the appended claims.

What is claimed is:

1. Air blast apparatus for a dryer section of a paper making machine having a plurality of tiers of drying cylinders comprising an upper tier and a lower tier for having a paper web trained therethrough, an endless gas-permeable support band urged against the paper web while the paper web is trained over the drying cylinders in the upper and lower tiers, a pocket formed generally by run-off and run-on portions of said paper web as said paper web passes from a first drying cylinder of one of said tiers to a drying cylinder of the other of said tiers and from said drying cylinder of said other of said tiers to a second drying cylinder of said one of said tiers, guide roller means situated generally between said first and second drying cylinders, said pocket being also formed by said endless support band as it passes from said first drying cylinder about said guide roller means and to said second drying cylinder, said air blast apparatus comprising air blast housing means situated as to extend transversely to the running direction of said endless support band, blow orifice means carried by said air blast housing means, said blow orifice means comprising a continuous ring slot orifice, said continuous ring slot orifice circumscribing a generally centrally situated land portion which is free from any additional blow orifice means, said continuous ring slot orifice comprising first and second longitudinal slot portions extending generally transversely of the running direction of said endless support band, said first longitudinal slot portion being the first of said longitudinal slot portions traversed by said support band in the running direction of said support band, said second longitudinal slot portion being the second of said longitudinal slot portions traversed by said support band in the running direction of said support band, the blow direction of said first longitudinal slot portion being generally normal to the running direction of the support band running therepast, and the blow direction of said second longitudinal slot portion being at an obtuse angle with respect to the running direction of the support band running therepast.

2. Air blast apparatus according to claim 1 wherein said blow orifice means comprises a plurality of continuous ring slot orifices, and wherein said plurality of continuous ring slot orifices are carried by said air blast housing means as to be serially situated with respect to each other in a direction generally transversely of said running direction of said endless support band.

3. Air blast apparatus according to claim 1 wherein the blow direction of said first longitudinal slot portion is in the order of magnitude of 70° to 110° with respect to said running direction of said support band running therepast.

4. Air blast apparatus according to claim 1 wherein the blow direction of said second longitudinal slot portion is in the order of magnitude of 100° to 140° with respect to said running direction of said support band running therepast.

5. Air blast apparatus according to claim 1 wherein said blow orifice means comprises a plurality of continuous ring slot orifices, wherein said plurality of continuous ring slot orifices are carried by said air blast housing means as to be serially situated with respect to each other in a direction generally transversely of said running direction of said endless support band, wherein each of said plurality of continuous ring slot orifices comprises a second longitudinal slot portion, and wherein the blow direction of each of said second longitudinal slot portions is in the order of magnitude of 100° to 140° with respect to said running direction of said support band running therepast.

6. Air blast apparatus according to claim 1 wherein said blow orifice means comprises a plurality of continuous ring slot orifices, wherein said air blast housing means comprises a plurality of air passage means, and wherein at least respective ones of said plurality of continuous ring slot orifices are in communication with respective ones of said plurality of air passage means.

7. Air blast apparatus according to claim 1 wherein said continuous ring slot orifice comprises a quadrangle-like slot orifice wherein said first and second longitudinal slot portions are spaced from each other and functionally interconnected by first and second transverse slot portions, and wherein said first and second transverse slot portions are each generally inclined relative to the running direction of said support band running therepast.

8. Air blast apparatus according to claim 7 wherein the blow direction of each of said transverse slot portions is inclined with respect to said support band as to be directed generally toward the interior of said quadrangle-like slot orifice.

9. Air blast apparatus according to claim 1 wherein said air blast housing is situated externally of said pocket and at a distance with respect to said first and second drying cylinders as to permit the air discharged from said continuous ring slot orifice to pass through said support band in the region generally between said first drying cylinder and said guide roller means and flow into said pocket and then flow out of said pocket by passing through said support band in the region generally between said second drying cylinder and said guide roller means.

10. Air blast apparatus according to claim 1 and further comprising sealing means situated generally between said air blast housing means and said guide roller means.

11. Air blast apparatus for a dryer section of a paper making machine having a plurality of tiers of drying cylinders comprising an upper tier and a lower tier for having a paper web trained therethrough, an endless gas-permeable support band urged against the paper web while the paper web is trained over the drying cylinders in the upper and lower tiers, a pocket formed generally by run-off and run-on portions of said paper web as said paper web passes from a first drying cylinder of one of said tiers to a drying cylinder of the other of said tiers and from said drying cylinder of said other of said tiers to a second drying cylinder of said one of said tiers, guide roller means situated generally between said first and second drying cylinders, said pocket being also formed by said endless support band as it passes from said first drying cylinder about said guide roller means and to said second drying cylinder, said air blast apparatus comprising air blast housing means situated as to extend transversely to the running direction of said endless support band, blow orifice means carried by said air blast housing means, said blow orifice means comprising a continuous annular slot orifice, said continuous annular slot orifice circumscribing a land portion which is free from any additional blow orifice means, said continuous annular slot orifice comprising first and second slot portions extending generally transversely of the running direction of said endless support band, said first slot portion being the first of said slot portions traversed by said support band in the running direction of said support band, said second slot portion being the second of said slot portions traversed by said support band in the running direction of said support band, the blow direction of said first slot portion being generally normal to the running direction of the support band running therepast, and the blow direction of said second slot portion being at an obtuse angle with respect to the running direction of the support band running therepast.

* * * * *